US005422192A

United States Patent [19]

Takahashi et al.

[11] Patent Number: 5,422,192

[45] Date of Patent: * Jun. 6, 1995

[54] STEEL PRODUCT WITH HEAT-RESISTANT, CORROSION-RESISTANT PLATING LAYERS

[75] Inventors: Teruhisa Takahashi; Seiya Takahata, both of Mishima, Japan

[73] Assignee: Usui Kokusai Sangyo Kaisha Ltd., Shizuoka, Japan

[ * ] Notice: The portion of the term of this patent subsequent to Oct. 22, 2008 has been disclaimed.

[21] Appl. No.: 301,724

[22] Filed: Sep. 7, 1994

Related U.S. Application Data

[63] Continuation of Ser. No. 139,879, Oct. 22, 1993, abandoned, which is a continuation of Ser. No. 960,215, Oct. 13, 1992, abandoned, which is a continuation of Ser. No. 723,721, Jun. 19, 1991, abandoned, which is a continuation of Ser. No. 418,306, Oct. 6, 1989, abandoned.

[51] Int. Cl.[6] ..... B32B 15/04

[52] U.S. Cl. ..... 428/632; 428/658; 428/659; 428/677

[58] Field of Search ..... 428/621, 632, 658, 659, 428/677, 680

[56] References Cited

U.S. PATENT DOCUMENTS

| | | | |
|---|---|---|---|
| 4,500,610 | 2/1985 | Gunn et al. | 428/621 |
| 4,663,245 | 5/1987 | Yoshida et al. | 428/632 |
| 4,713,301 | 12/1987 | Higuchi et al. | 428/632 |
| 4,849,301 | 7/1989 | Kanasashi | 428/632 |
| 5,059,493 | 10/1991 | Takahata | 428/658 |

*Primary Examiner*—George Wyszomierski
*Attorney, Agent, or Firm*—Nikaido, Marmelstein Murray & Oram

[57] ABSTRACT

A steel product (or copper-plated steel product) with heat-resistant, corrosion-resistant plating layers which are composed of a 0.2–10 μm thick nickel plating layer formed on said steel product, a Zn-Ni alloy plating layer formed on said nickel plating layer, and a chromate film formed on said Zn-Ni alloy plating layer.

6 Claims, No Drawings

STEEL PRODUCT WITH HEAT-RESISTANT, CORROSION-RESISTANT PLATING LAYERS

This application is a continuation of application Ser. No. 08/139,879, filed on Oct. 22, 1993, which is a continuation of 07/960,215, filed Oct. 13, 1992, which is a continuation of 07/723,721, filed Jun. 19, 1991, which is a continuation of Ser. No. 07/418,306, filed Oct. 6, 1989, all abandoned.

BACKGROUND OF THE INVENTION

1. Field of the Invention

The present invention relates to a steel product with heat-resistant, corrosion-resistant plating layers, and more particularly, to a steel product such as sheets, pipes, couplings, clamps, bolts, and-nuts used for automobiles and various machines and equipment, said steel product having heat-resistant, corrosion-resistant plating layers on the surface thereof.

2. Description of the Prior Art

It has been a common practice to form a zinc plating layer and then a chromate film on sheets, pipes, couplings, clamps, bolts, and nuts used for automobiles and various machines and equipment. However, it has been found that the zinc plating alone does not meet the requirement for these components which has become severer than before. For the improved corrosion resistance, the zinc plating has been superseded by Sn-Zn or Zn-Ni alloy plating or a combination of this alloy plating and Zn plating. In this connection, there is disclosed in Japanese Patent Laid-open No. 165387/1985 a corrosion-resistant steel pipe with plating layers composed of an electroplated Zn-Ni alloy layer (on the outside of the steel pipe), an electroplated zinc layer (on the Zn-Ni alloy layer), and a chromate film (on the zinc layer).

The above-mentioned plated steel products exhibit improved corrosion resistance in corrosive environments at normal temperature but they do not in high-temperature environments such as automotive engine rooms.

SUMMARY OF THE INVENTION

The present invention was completed to solve the above-mentioned problem. Accordingly, it is an object of the present invention to provide a steel product with plating layers which exhibits not only high corrosion resistance but also good heat resistance.

The present inventors carried out a series of researches which led to the finding that the object of the present invention is achieved if the plating layers are composed of a nickel plating layer of specific thickness (as the lower layer), a Zn-Ni alloy plating layer (as the intermediate layer), and a chromate film (as the top layer). The present invention was completed on the basis of this finding. The gist of the present invention resides in a steel product (or copper-plated steel product) with heat-resistant, corrosion-resistant plating layers which are composed of a 0.2–10 μm thick nickel plating layer formed on said steel product, a Zn-Ni alloy plating layer formed on said nickel plating layer, and a chromate film formed on said Zn-Ni alloy plating layer.

DETAILED DESCRIPTION OF THE INVENTION

The steel product pertaining to the present invention includes sheets, pipes, couplings, clamps, bolts, nuts, and the like. The steel product also includes a comparatively thin lap-welded steel tube (10 mm or below in outside diameter) with copper plating for welding. (Such a steel tube may be used for automotive hydraulic and fuel piping.) It has three plating layers. The lower layer is a 0.2–10 μm thick nickel plating layer. With a thickness less than 0.2 μm, this layer does not cover the ground of a steel product completely, nor does it improve heat resistance and corrosion resistance so much. With a thickness in excess of 10 μm, this layer is liable to peel and crack during bending and hence does not improve corrosion resistance for its increased thickness. This nickel plating layer may be formed by electroplating using a Watts bath, which provides a plating layer having less stress. The intermediate layer is a Zn-Ni alloy plating layer, which may be formed by electroplating using a chloride bath or sulfate bath. The content of nickel varies depending on the bath composition and current density; but it should be 2 to 20%, preferably 12 to 15%, for improved corrosion resistance, bendability, and ease with which the chromate film is formed thereon afterwards. The top layer is a chromate film, which may be formed from a chromate solution or dichromate-sulfuric acid solution or a commercial chromate treating solution (e.g., ZN-80 YMU, a product of Ebara-Udylite Co., Ltd.).

The thus obtained steel product with plating layers exhibits good corrosion resistance even in high-temperature environments and on its bent parts, as demonstrated in Examples which follow.

EXAMPLES

The invention will be described in more detail with reference to the following examples.

Example 1

A lap-welded steel tube, measuring 8 mm in diameter, 0.7 mm in wall thickness, and 380 mm long, was made of cold rolled carbon steel sheet designated as SPCC according to JIS G-3141, with the surface thereof coated with an about 3-μm thick copper plating layer for welding. This tube underwent nickel plating in a Watts bath at a bath temperature of 52°–57° C. with a current density of 3 A/dm$^2$. The plating thickness ranged from 0.5 μm to 10 μm. The plated steel tube further underwent Zn-Ni alloy plating for 6 minutes in a bath solution (pH 5.7) containing 100 g/L of $ZnCl_2$, 130 g/L of $NiCl_2 \cdot 6H_2O$, and 200 g/L of $NH_4Cl$ at a bath temperature of 34°–36° C. with a current density of 3 A/dm$^2$. Thus there was formed a 5-μm thick Zn-Ni alloy plating layer on the nickel plating layer. The Zn-Ni alloy plating layer was further coated with a chromate film by dipping in ZN-80 YMU (a product of Ebara-Udylite Co., Ltd.) at pH 2.0 and a bath temperature of 48°–52° C. for 20 seconds. Thus there was obtained a steel tube having plating layers.

The plated tube, with one end bent through 180° around a mandrel 25 mm in radius, was examined for corrosion resistance by salt spray test according to JIS Z-2371. The time (in days) required for red rust to occur was measured. The plated tube was also examined for heat resistance and corrosion resistance by heating at 200° C. for 24 hours and then by salt spray test according to JIS Z-2371. The time (in days) required for red rust to occur was measured. Both tests were carried out using two The results are shown in Table 1. (Sample samples each. Nos. 1 to 5.)

Example 2

An electric welded steel tube of the same dimensions as in Example 1 was made of carbon steel designated as STPG-38 according to JIS G-3454. The steel tube was plated and tested in the same manner as Example 1. The results are shown in Table 1. (Sample Nos. 6 to 10.)

Comparative Example 1

A lap-welded steel tube having plating layers and an electric welded steel tube having plating layers were produced in the same manner as in Examples 1 and 2, respectively, except that the nickel plating was 0.1 μm thick or 15 μm thick. The steel tubes were tested in the same manner as in Example 1. The results are shown in Table 1. (Sample Nos. 11 to 14.)

Comparative Example 2

The same lap-welded steel tube as in Example 1 and the same electric welded steel tube as in Example 2 were provided with a Zn-Ni alloy plating layer and chromate film, without the formation of a nickel plating layer, in the same manner as in Example 1. The steel tubes were tested in the same manner as in Example 1. The results are shown in Table 1. (Sample Nos. 15 and 16.)

Comparative Example 3

The same lap-welded steel tube as in Example 1 and the same electric welded steel tube as in Example 2 were provided with a Zn-Ni alloy plating layer, a zinc plating layer, and a chromate film on top of the other. The Zn-Ni alloy plating layer was formed in the same manner as in Example 1. The zinc plating layer was formed using a bath containing 28 g/L of ZnO, 50 g/L of NaCN, and 80 g/L of NaOH. The chromate film was formed using a treating solution containing 2 g/L of $CrO_3$, 0.25 mL/L of $H_2SO_4$, and 0.5 mL/L of $HNO_3$. The thus obtained steel tube with plating layers composed of a Zn-Ni alloy plating layer, Zn plating layer, and chromate film was tested in the same manner as in Example 1. The results are shown in Table 1. (Sample Nos. 17 and 18.)

TABLE 1

| Example No. | Sample No. | Steel tube* | Thickness of nickel plating (μm) | Thickness of Zn—Ni alloy plating (μm) | Thickness of zinc plating (μm) | Corrosion resistance** | | Heat and corrosion resistance** | |
|---|---|---|---|---|---|---|---|---|---|
| | | | | | | Bent part | Straight part | Bent part | Straight part |
| 1 | 1 | A | 0.5 | 5 | — | 84 | 105 | 63 | 105 |
| | | | | | | 105 | 136 | 63 | 105 |
| 1 | 2 | A | 1.0 | 5 | — | 105 | 136 | 84 | 105 |
| | | | | | | 84 | 105 | 63 | 136 |
| 1 | 3 | A | 2.5 | 5 | — | 125 | 84 | 84 | 125 |
| | | | | | | 105 | 125 | 75 | 125 |
| 1 | 4 | A | 5.0 | 5 | — | 156 | >209 | 146 | 156 |
| | | | | | | 105 | 146 | 105 | 146 |
| 1 | 5 | A | 10.0 | 5 | — | 63 | 156 | 75 | 209 |
| | | | | | | 105 | 209 | 63 | 136 |
| 2 | 6 | B | 0.5 | 5 | — | 105 | 125 | 84 | 125 |
| | | | | | | 105 | 136 | 75 | 105 |
| 2 | 7 | B | 1.0 | 5 | — | 125 | 156 | 84 | 125 |
| | | | | | | 84 | 105 | 84 | 105 |
| 2 | 8 | B | 2.5 | 5 | — | 105 | 136 | 84 | 105 |
| | | | | | | 136 | 156 | 105 | 136 |
| 2 | 9 | B | 5.0 | 5 | — | 125 | 146 | 125 | 146 |
| | | | | | | 156 | 209 | 136 | 209 |
| 2 | 10 | B | 10.0 | 5 | — | 84 | 175 | 75 | 154 |
| | | | | | | 75 | 146 | 63 | 146 |
| (1) | 11 | A | 0.1 | 5 | — | 75 | 75 | 6 | 15 |
| | | | | | | 50 | 75 | 10 | 25 |
| (1) | 12 | A | 15.0 | 5 | — | 40 | 146 | 42 | 156 |
| | | | | | | 42 | 156 | 30 | 125 |
| (1) | 13 | B | 0.1 | 5 | — | 75 | 105 | 15 | 25 |
| | | | | | | 75 | 125 | 15 | 40 |
| (1) | 14 | B | 15.0 | 5 | — | 42 | 125 | 40 | 146 |
| | | | | | | 42 | 175 | 30 | 105 |
| (2) | 15 | A | 0 | 5 | — | 75 | 84 | 6 | 15 |
| | | | | | | 63 | 50 | 6 | 15 |
| (2) | 16 | B | 0 | 5 | — | 84 | 105 | 10 | 25 |
| | | | | | | 63 | 105 | 15 | 30 |
| (3) | 17 | A | — | 5 | 5 | 30 | 75 | 3 | 3 |
| | | | | | | 25 | 84 | 3 | 3 |
| (3) | 18 | B | — | 5 | 5 | 25 | 84 | 6 | 10 |
| | | | | | | 40 | 105 | 3 | 7 |

*A: lap-welded steel tube, B: electric welded steel tube
**Time (in days) required for red rust to occur.
Parenthesized numbers indicate Comparative Examples.

The steel product of the present invention has plating layers formed on top of the other, the lower layer being a nickel plating layer having a specific thickness, the intermediate layer being a Zn-Ni alloy plating layer, and the top layer being a chromate film. Owing to the plating layers, it exhibits outstanding corrosion resistance and retains it even after heat treatment or on its bent parts. Therefore, it is suitable for use in high-temperature environments such as automotive engine-room.

What is claimed is:

1. A steel product with heat-resistant, corrosion-resistant plating layers which are composed of a 0.2–10 μm thick nickel plating layer formed on said steel product, a Zn-Ni alloy plating layer formed on said nickel plating layer, and as a topcoat a film consisting essentially of chromate formed on said Zn-Ni alloy plating layer.

2. A steel product as claimed in claim 1, wherein the Zn-Ni alloy plating layer contains 2–20% of nickel.

3. A steel product as claimed in claim 1, wherein the Zn-Ni alloy plating layer contains 12–15% of nickel.

4. A steel product plated with copper and with heat-resistant, corrosion-resistant plating layers which are composed of a 0.2–10 μm thick nickel plating layer formed on said copper-plated steel product, a Zn-Ni alloy plating layer formed on said nickel plating layer, and as a topcoat a film consisting essentially of chromate formed on said Zn-Ni alloy plating layer.

5. A steel product as claimed in claim 4, wherein the Zn-Ni alloy plating layer contains 2–20% of nickel.

6. A steel product as claimed in claim 4, wherein the Zn-Ni alloy plating layer contains 12–15% of nickel.

* * * * *